United States Patent [19]

Grosse et al.

[11] 4,151,823

[45] May 1, 1979

[54] QUICK-CHANGE OIL FILTER/RESERVOIR SYSTEM FOR INTERNAL COMBUSTION ENGINE

[76] Inventors: Leland J. Grosse, 754A Lonetree Way, Brentwood, Calif. 93413; John B. Wessman, 737 Grayson Rd., Pleasant Hill, Calif. 94523

[21] Appl. No.: 819,798

[22] Filed: Jul. 28, 1977

[51] Int. Cl.[2] ..... F01M 1/00

[52] U.S. Cl. ..... 123/196 A; 210/167; 210/168

[58] Field of Search ..... 123/196 R, 196 A; 184/6, 1.5; 210/167, 168

[56] References Cited

U.S. PATENT DOCUMENTS

| | | | |
|---|---|---|---|
| 2,002,165 | 5/1935 | Winslow | 123/196 A |
| 2,014,445 | 9/1935 | Miller | 210/168 |
| 2,976,864 | 3/1961 | Ford | 123/196 A |
| 3,432,005 | 3/1969 | Gates | 123/196 A |

*Primary Examiner*—Ronald H. Lazarus
*Attorney, Agent, or Firm*—Townsend and Townsend

[57] ABSTRACT

A quick-change oil filter/reservoir system for an internal combustion engine is provided in the form of a cartridge or canister containing an oil filter and precharged with a fresh supply of engine oil. The cartridge is releasably carried on a mount by quick-release fasteners and includes non-manipulative, self-sealing input and output fittings on the bottom surface which engage corresponding oil lines provided on the cartridge mount and connected to the engine oil pumps. In addition to the engine's primary oil pump, a secondary or scavanging oil pump is provided to continuously return engine oil from the engine's sump to the filter/reservoir cartridge. To accomplish an oil and filter change, the used cartridge, containing the used filter and the bulk of the used engine oil, is merely replaced with a new cartridge containing a fresh filter and engine oil.

9 Claims, 4 Drawing Figures

QUICK-CHANGE OIL FILTER/RESERVOIR SYSTEM FOR INTERNAL COMBUSTION ENGINE

Figure 1:
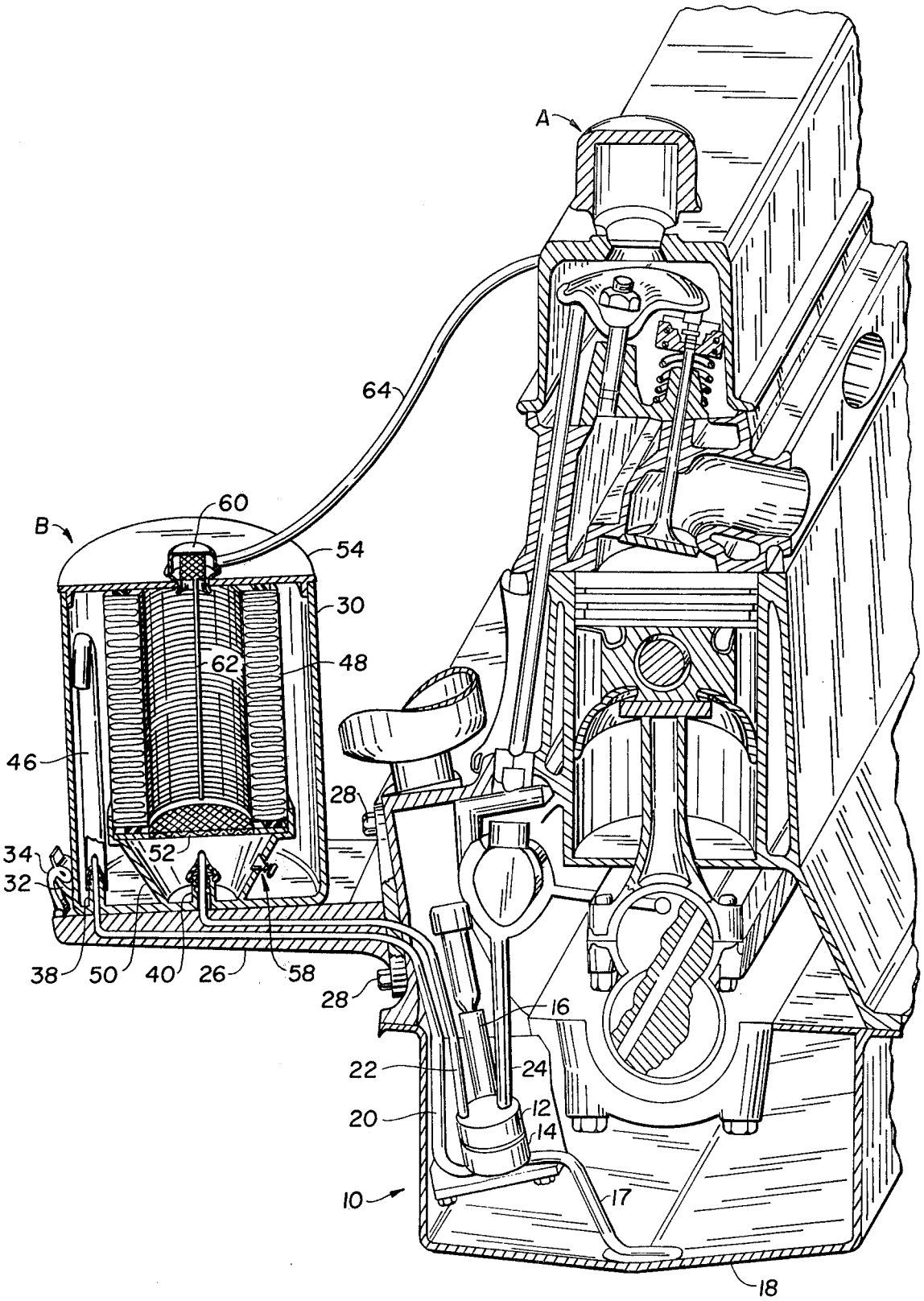

The present invention relates generally to lubrication systems for internal combustion engines, and, more particularly, to a quick-change oil filter/reservoir system therefor.

Despite improvements in engine lubricants and lubricating systems, the periodic replacement of engine oil and oil filters is still regarded as an essential maintenance procedure for internal combustion engines, such as those found in automobiles. The so-called "periodic oil change" conventionally requires draining the engine sump and removing and replacing the engine oil filter. Several drawbacks of these procedures are apparent. Access to the engine sump drain plug and oil filter are generally from the underside, rendering the procedure awkward and often requiring the use of a lift or jack. Further hand tools are usually required to manipulate the drain plug and oil filter. The used engine oil, commonly referred to as "drain oil", must be captured and suitably disposed of. While garages and service stations are suitably equipped to handle and dispose of drain oil, this aspect of an oil change procedure often poses a significant problem for the layman. As a result, only a relatively small percentage of the drain oil is now subject to recycling. In addition, conventional oil change procedures involve open handling of both the fresh and drain oils, posing a substantial risk of spillage.

Accordingly, a primary object of the present invention is to provide an improved oil and filter replacement system for internal combustion engines that is simpler, faster and more efficient than the apparatus and procedures presently employed.

Another object of the present invention is to provide a quick-change oil filter/reservoir cartridge for internal combustion engines which may be removed and replaced as a single unit in a simple and efficient manner.

A further object of the present invention is to provide a quick-change and oil filter/reservoir system for an internal combustion engine which substantially eliminates open handling of both the fresh and drain oils.

Still another object of the present invention is to provide a quick-change oil filter/reservoir system for internal combustion engine which facilitates the recycling of drain oil.

To these ends, the present invention provides a quick-change filter/reservoir system comprising a cartridge or canister containing a filter and a sufficient volume of oil supply for the engine. The oil filter/reservoir cartridge is precharged with a fresh supply of oil and includes non-manipulative, self sealing input and output fittings. A suitable mounting for the oil filter/reservoir cartridge is provided, including input and output oil lines which engage the corresponding fittings of the cartridge, and are appropriately connected to the engine oil pumps. The cartridge is removably carried on the mounting by quick-release fasteners.

In addition to the conventional or primary oil pump, the engine is fitted with a secondary or scavanging oil pump to continuously return the oil from the engine sump to the cartridge, thereby operating the engine in the so-called dry sump configuration. In this manner, the bulk of the engine oil supply will, at all times, be contained in the cartridge. According to the preferred embodiment of the present invention, the primary oil pump and scavanging oil pump may comprise a single, two-stage pump mounted in the conventional location interior of the engine sump, driven by the distributor-/oil pump drive shaft. Alternatively, the conventional single-stage primary oil pump may be retained interior of the sump and an additional scavanging pump may be mounted exterior of the engine, driven by the engine fan belt.

In accordance with the present invention, the oil and filter change procedure is greatly simplified. To accomplish same, the quick-release mountings for the oil filter/reservoir cartridge are disengaged and the used cartridge containing the bulk of the drain oil and used filter element is merely lifted upward, disengaging the input and output pipes from the non-manipulative, self-sealing fittings. A new cartridge, containing a new filter and a supply of fresh engine oil, may immediately be substituted therefor, in reverse manner. These operations may preferably be performed from the top side of the engine, and should not require the use of any tools whatsoever. Open handling of both the fresh and drain oils is eliminated.

In addition, the oil filter/reservoir cartridge of the present invention is particularly well-suited for recycling. Used cartridges containing drain oil may be returned to a suitable recycling facility where the cartridge may be opened and the drain oil removed for recycling. If desired, the used cartridges may be cleaned, refitted with a new filter element, recharged with a supply of fresh oil, resealed and reused.

Figure 2:
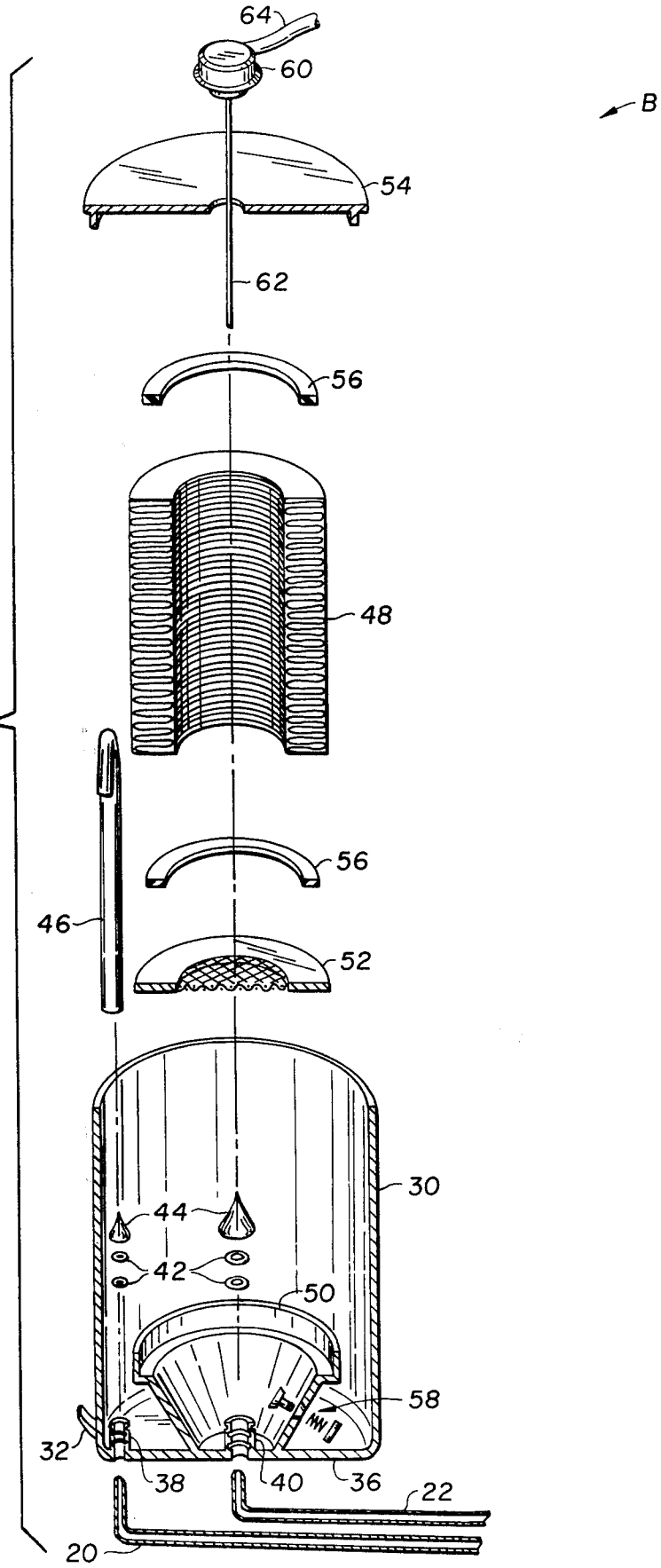
Figure 3:
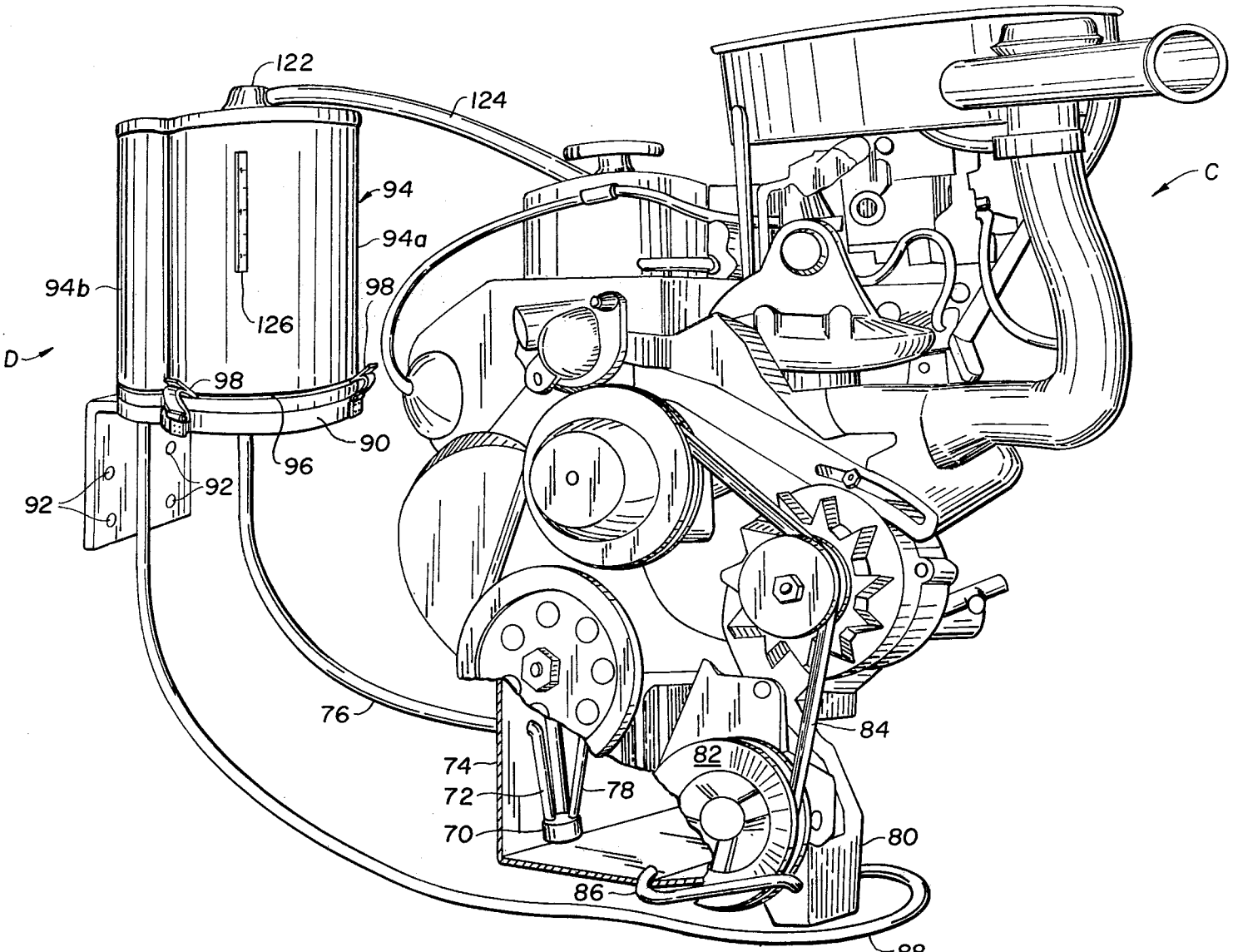
Figure 4:
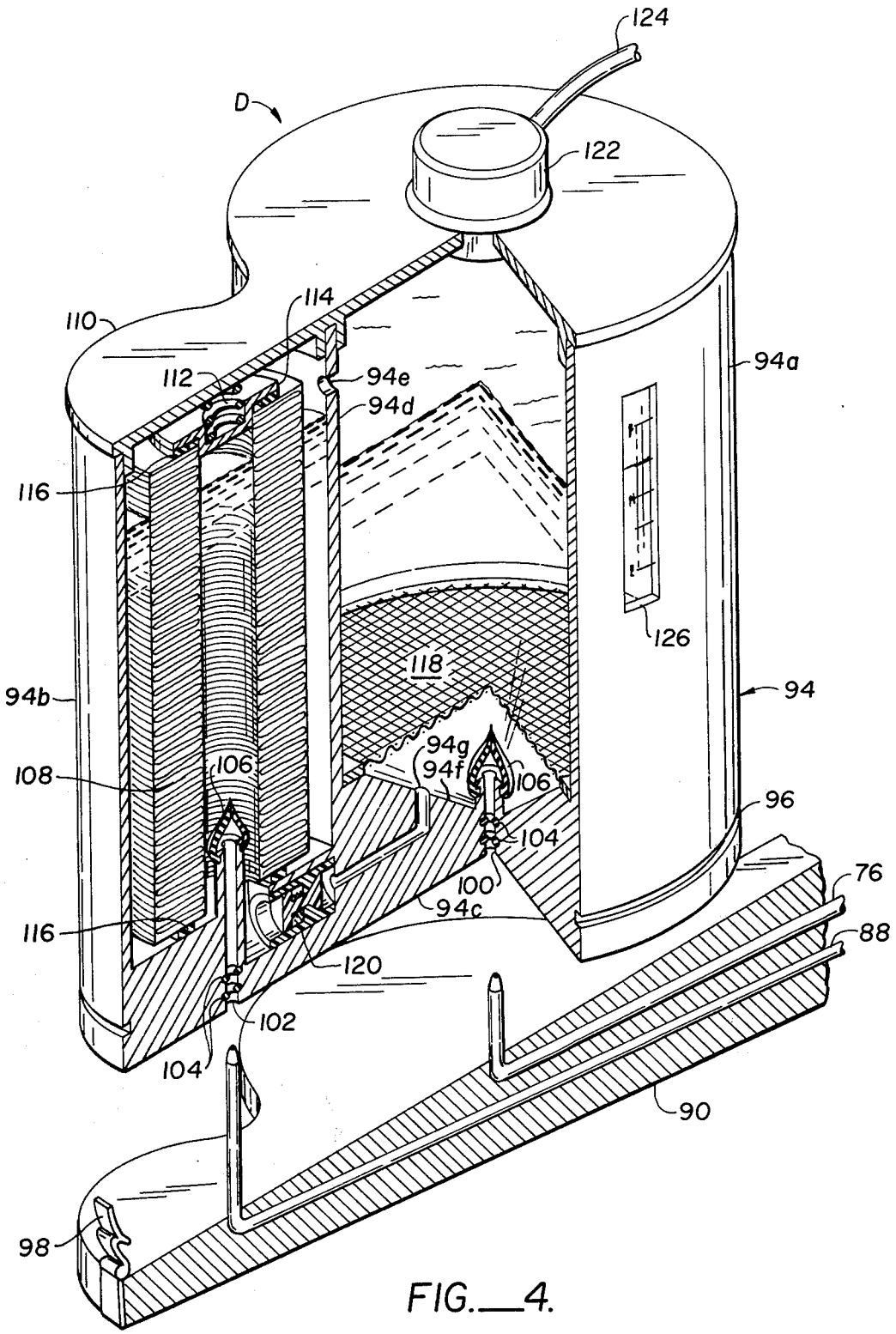

These and other objects, features and advantages of the present invention will be more readily apparent from the following detailed description, wherein reference is made to the accompanying drawings, in which:

FIG. 1 is a cross-sectional, perspective view of an internal comubstion engine having a quick-change oil filter/reservoir system according to the preferred embodiment of the present invention;

FIG. 2 is an exploded, cross-sectional, perspective view of the oil filter/reservoir cartridge portion of the apparatus of FIG. 1; and FIG. 3 is a perspective view, partially broken-away, of an internal combustion engine having a quick change oil filter/reservoir system according to an alternative embodiment of the present invention; and FIG. 4 is a perspective view, partially broken-away, of the oil filter/reservoir cartridge portion of the apparatus of FIG. 3.

Referring initally to FIGS. 1 and 2, the preferred embodiment of the present invention will now be described in detail. There is generally depicted an internal combustion engine A of a type typically employed in automobiles, fitted with a quick-change oil filter/reservoir system B according to the present invention. Engine A is generally conventional with the exception of its lubrication system which will now be described.

Engine A is fitted with an internal, two-stage oil pump, shown generally at 10. Oil pump 10 includes a primary oil pump stage 12 and a secondary or scavenging oil pump stage 14 coaxially mounted for rotation by a common shaft 16, driven by the distributor/oil pump drive in a conventional manner. A pickup tube 17 is connected to the input of the scavenging pump 14 and preferrably extends to the lowest point of the sump or pan 18. The output of scavenging pump 14 is connected to a pipe 20 which directs the scavenged oil to the oil filter/reservoir B.

Filtered oil from the oil filter/reservoir B is returned through a pipe 22 to the input of the primary oil pump stage 12. The output of primary pump 12 is supplied at pressure to the engine oil lines and galleys through output line 24, in a conventional manner. Filtered oil from the filter/reservoir B is thus continuously pumped through the engine for lubrication.

Engine A is further provided with a mounting plate 26 for the oil filter/reservoir B, which may be secured to the engine block by a plurality of bolts 28.

The oil filter/reservoir B according to the present invention generally comprises a cartridge or canister 30 of sufficient volume to contain a filter and appropriate quantity of engine oil, typically in the range of four to five quarts. The particular shape of cartridge 30 is not critical to the overall objectives of the present invention, and the hollow cylinder form depicted in FIGS. 1 and 2 is merely intended to be exemplary. Likewise, the materials from which cartridge 30 is constructed are not critical, provided that the cartridge 30 possesses sufficient intregrity to remain oil tight under the range of operating temperatures, pressures and other conditions encountered. Typically canister 30 may be constructed of either sheet metal or molded plastic.

According to the present invention, cartridge 30 is mounted to mounting plate 26 by conventional quick-release mountings. For example, the cartridge 30 may be provided with a plurality of outwardly extending tabs 32 which are engaged by spring clips 34 carried on mounting plate 26. The bottom surface 36 of canister 30 includes non-manipulative, self-sealing input and output fittings 38 and 40 which receive the upwardly extending ends of oil pipe 20 and 22, respectively.

Each of the fittings 38 and 40 comprises a tubular orifice provided with annular grooves carrying a plurality of O-rings 42. The ends of the pipes 20 and 22 pass upwardly through the orifices with the O-rings 42 acting as seals therebetween. Each of the fittings 38 and 40 further includes a self-sealing feature in the form of a slitted diaphragm 44 which seals the orifices in the absence of pipes 20 and 22. Specifically the diaphragms 44 comresilient neoprene or other plastic and include a slit through which the pipes 20 or 22 may pass. Absent the pipes 20 or 22, the resiliency of the diaphragms 44 maintain the slits in a closed position to seal the fitting 38 and 40.

Inlet fitting 38 is internally connected to an oil discharge tube 46 which directs the oil from the scavenging pump to the upper peripheral portion of the cartridge 30.

An oil filter element 48 is provided interior of the cartridge 30. Specifically, filter element 48 is supported at one end on a hollow frusto-conical base 50 carried on the interior of the bottom surface 36 of the cartridge 30. A wire mesh screen 52 may be disposed between filter element 48 and base 50 as a safety screen to prevent large particles from returning to the engine A from the cartridge 30. The other end of the filter element 48 is supported by the top 54 of the canister 30, and a pair of sealing rings 56 are provided at respective ends of the filter element 48 to seal the filter element at its top and bottom. The filter element 48 thus defines two regions interior of the cartridge 30. The first region exterior of the filter element is intended to receive the scavenged oil from the engine, and thus input fitting 38 and discharge pipe 46 are disposed in the cartridge 30 exterior of the filter element 48. The second region defined interior of filter element 48 is intended to receive the filtered oil and output fitting 40 is disposed interior of base 50 on the bottom surface 36 of the cartridge 30. Thus, oil flows through the cartridge 30 in generally inward radial directions, through filter element 48, to accomplish filtration.

An oil pressure relief or by-pass valve 58 is provided on base 50, connecting the scavenged oil exterior of the filter element 48 with the filtered oil interior thereof under high pressure conditions. Thus, when oil flow through the filter element 48 is insufficient, as occurs when the filter element becomes clogged, pressure will build interior of the cartridge 30 causing relief valve 58 to open. Unfiltered oil is thereby returned to the engine A as a safety measure to insure an adequate supply of lubricating oil under all conditions.

The top 54 of cartridge 30 is provided with a breather cap 60 to discharge gases received in the cartridge 30. Such gases are preferably returned to the emission control system of the engine through a breather hose 64. Breather cap 60 may include a downwardly depending dip stick 62 which may be employed to measure the oil level in the cartridge 30, and thus the oil level of the engine A.

In operation, scavenged oil from the engine sump 18 is directed through pickup tube 17, scavenging pump 14, pipe 20, fitting 38 and discharge tube 46 to the interior of cartridge 30 in the region exterior of filter element 48. The scavenged oil passes through filter element 48 to become filtered oil and is returned to the engine through fitting 40, pipe 22 and primary oil pump 12. Since the sump 18 is continuously scavenged, the bulk of the engine oil is continuously contained within the cartridge 30.

In order to change the oil and oil filter, the cartridge 30 need merely be removed and replaced with a fresh unit containing a new filter and a fresh supply of oil. To accomplish such an oil and filter change, the spring clips 34 are disengaged from the tabs 32 and the cartridge 30 is lifted upward to disengage the pipes 20 and 22 from the fittings 38 and 40. Upon removal, self-sealing diaphragms 44 seal the fittings 38 and 40 to contain the drain oil in the used cartridge 30.

A new cartridge 30 containing a new filter element and fresh oil is fitted by the reverse of the foregoing procedures. Thus, the self-sealing diaphragms 44 initially contain the oil in the cartridge 30. As the cartridge 30 is lowered onto the mounting plate 26, pipe 20 and 22 enter fittings 38 and 40 and pierce the slits in the diaphrams 44 to connect the cartridge 30 with the engine as described above.

Used cartridge 30 containing the used oil is substantially sealed as described heretofor and may conveniently be transported to a suitable facility for recycling. At said facility, cover 54 may be removed from the cartridge 30 to provide access to the used oil contained herein. The used oil may then be refined into fuels lubricants or other petroleum products. If desired, the used cartridge 30 may itself be recycled. Specifically, the used filter element 48 may be removed and, after cleaning of the cartridge 30, a new filter element 48 may be replaced, along with a supply of fresh oil. Top 54 may then be re-sealed on to the cartridge 30, rendering the cartridge recycled and ready for re-use.

Referring now to FIGS. 3 and 4, an alternative embodiment of the present invention particularly adapted for the retro-fitting of existing engines will now be described in detail. There is generally depicted an internal combustion engine C of generally conventional construction, provided with a quick-change oil filter/-reservoir system D according to an alternative embodiment of the present invention.

Engine C is fitted with a conventional single-stage oil pump 70 interior of its sump. Input pipe 72 of oil pump 70 would conventionally be connected to an oil pickup interior of the sump. However, in accordance with the alternative embodiment of the present invention, input pipe 72 is fitted through a hole drilled in the sump 74 and connected to an oil supply hose 76 from the filter/-reservoir D. The output of oil pump 70 is connected to the engine oil passages and galleys by output pipe 78 in a conventional manner.

In order to scavenge the oil from the sump 74 and return same to the filter/reservoir D, an external scavenging pump 80 is mounted to the engine C exterior of the sump. Scavenging pump 80 includes a pulley 82 driven by the fan belt 84 of the engine C. The input of scavenging pump 80 is connected to a pickup tube 86 directed through a hole in the sump 74, which may comprise the original drain plug hole, to the interior thereof, preferrably at the lowest point. The output of scavenging pump 80 is connected to an oil return hose 88 which directs the scavenged oil to the filter/reservoir D. Thus, engine C has been modified to accomodate an external filter/reservoir D while retaining its original single-stage oil pump 70.

Filter/reservoir D functions in a substantially identical manner to filter/reservoir B described herein before, and filter/reservoir D merely depicts an alternative embodiment therefor. Thus, filter/reservoir D generally comprises a cartridge or canister 94 having a volume sufficient to accomodate a filter element and an adequate supply of engine oil. As depicted, cartridge 94 is a generally unitary structure, typically of molded plastic in the form of two abutting, parallel hollow cylinders **94*a* and 94*b* having a common bottom surface 94*c*. The bottom 94*c* of the cartridge is adapted for quick-release mounting to a mounting bracket or plate 90. Specifically, cartridge 94 is provided along its lower edge with an annular groove 96 engagable by a plurality of spring clips 98 carried on the mounting bracket 90**.

The bottom surface **94*c* of cartridge 90 includes non-manipulative, self-sealing output and input fittings 100 and 102, respectively corresponding to fittings 38 and 40 described heretofor and thus include a plurality of O-rings 104 and self-sealing diaphragms 106**.

The cartridge 94 includes an interior wall **94*d* separating the cylindrical portions 94*a* and 94*b*, so that cylindrical portion 94*b* defines a filter chamber while cylindrical portion 94*a* defines a reservoir chamber. Input fitting 102 thus communicates with filter chamber 94*b* while output fitting 100 communicates with reservoir chamber 94*a***.

An oil filter element 108 is provided within filter chamber **94*b* in a generally conventional manner. Thus, the top end of the filter element 108 is urged downwardly from the top 110 of cartridge 94 by a spring 112 bearing upon a disc 114. A pair of sealing rings 116 seal the upper and lower ends of the filter element 108. Inlet fitting 102 is disposed interior of the filter element 108 to input the scavenged oil interior thereof. Oil flows outwardly through the filter element 108, receiving filtration and filling the oil filter chamber 94*b*. An aperture 94*e* is provided in interior wall 94*d* to direct the filtered oil from the filter chamber 94*b* to the reservoir chamber 94*a***.

Reservoir chamber **94*a* is substantially hollow and communicates with output fitting 100. A wire mesh filter screen 118, substantially identical to screen 52 described heretofor, is provided interior of the reservoir chamber 94*a***, to prevent large particles from returning to the engine C.

An oil pressure relief valve 120 connects the input and output fittings 100 and 102 through a passage **94*g* in the bottom 94*f* of the reservoir chamber 94*a*. Pressure relief valve 120 functions to bypass the filter in like manner to valve 58 described heretofor. Likewise, the top 110 of the canister 94 includes a breather cap 122 and breather hose 124, analagous to breather cap 60 and hose 64 described heretofor. The oil reservoir chamber 94*a* may be provided with a transparent window or a sight glass 126** by which the engine oil level may be monitored.

In operation, scavenged oil from the sump 74 is directed through pickup tube 86, pump 80, hose 88 and fitting 102 to the interior of filter element 108. The scavenged oil passes radially outward therethrough to fill the filter chamber **94*b* with filtered oil. The filtered oil overflows filter chamber 94*b* into reservoir chamber 94*a* through orifice 94*e*. Oil in the reservoir chamber 94*a* passes through screen 118, fitting 100, pipes 76 and 72, pump 70 and pipe 78 to the engine oil passages. Once again, the continuous scavenging of the sump causes the bulk of the oil to be contained in the cartridge 94**, to enable replacement of the oil supply and filter in a single operation as heretofor described.

While particular embodiments of the present invention have been shown and described in detail it is to be expressly understood that such adaptations and modifications as may occur to those skilled in the art are within the spirit and scope of the present invention, as set for in the claims.

What is claimed is:

1. A quick-change oil filter/reservoir system for an internal combustion engine having a primary oil pump and oil sump comprising:

a cartridge containing an oil filter element and a supply of oil, said cartridge having non-manipulative and self-sealing input and output fittings;

a cartridge mounting for releasably carrying said cartridge, said mounting including input and output oil pipes corresponding to and engageable by said input and output fittings, respectively;

scavenging pump means for continuously returning oil from said sump to said input oil pipe; and means connecting said output pipe to the input of said primary oil pump.

2. Apparatus according to claim 1 wherein said input and output fittings are disposed on one planar surface of said cartridge and said cartridge mounting includes a planar surface adapted to abut said mounting planar surface of said cartridge.

3. Apparatus according to claim 2 wherein the ends of said input and output oil pipes extend outwardly from said planar surface of said mounting and each of said fittings comprises a a tubular orifice and a resilient, split-diaphragm self-seal adapted to receive said pipe therethrough.

4. Apparatus according to claim 3 comprising at least one O-ring disposed between said pipe and said tubular orifice.

5. A quick-change oil filter/reservoir system for an internal combustion engine having a primary oil pump and an oil sump comprising:

a cartridge containing an oil filter element and a supply of oil, said cartridge having female input and output fittings disposed on one planar surface, said fittings being self-sealing and non-manipulative;

a cartridge mounting having quick-release fasteners for releasably carrying said cartridge, said mounting including a planar surface having a male input and output oil pipes corresponding to and engageable by said input and output fittings, respectively;

scavanging pump means for continuously returning oil from said sump to said input oil pipe; and means connecting said output pipe to the input of said primary oil pump.

6. Apparatus according to claim 5 wherein each of said fittings comprises a tubular female orifice and a resilient, split-diaphragm self-seal adapted to receive said male pipe therethrough.

7. Apparatus according to claim 5 wherein said cartridge comprises a generally hollow cylinder, said filter element being cylindrical and coaxial therewith to define a peripheral region exterior of said filter element for receiving scavanged oil and a central region interior of said filter element for receiving filtered oil.

8. Apparatus according to claim 7 wherein said input fitting communicates with said exterior portion and said output fitting communicates with said central portion.

9. Apparatus according to claim 5 wherein said cartridge comprises two joined hollow, abutting cylinders, one of said cylinders comprising a filter chamber and the other of said cylinders comprising a reservoir chamber and an aperture therebetween for supplying filtered oil from said filter chamber to said reservoir chamber.

* * * * *